US008320793B2

(12) United States Patent
Xu et al.

(10) Patent No.: US 8,320,793 B2
(45) Date of Patent: Nov. 27, 2012

(54) DEVELOPMENT DEVICE AND PRINTER HAVING THE SAME

(75) Inventors: Fan Xu, Aichi (JP); Takashi Yasuda, Aichi (JP); Mitsuru Horinoe, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 252 days.

(21) Appl. No.: 12/881,483

(22) Filed: Sep. 14, 2010

(65) Prior Publication Data

US 2011/0064454 A1 Mar. 17, 2011

(30) Foreign Application Priority Data

Sep. 15, 2009 (JP) ..... 2009-213285

(51) Int. Cl.
*G03G 15/08* (2006.01)

(52) U.S. Cl. ..... 399/103; 399/119

(58) Field of Classification Search ..... 399/103, 399/105, 111, 113, 119
See application file for complete search history.

(56) References Cited

U.S. PATENT DOCUMENTS 5,729,796 A 3/1998 Miura et al.
7,983,590 B2 * 7/2011 Sakuma ..... 399/102
8,023,864 B2 * 9/2011 Takagi et al. ..... 399/262

FOREIGN PATENT DOCUMENTS

JP 8-16067 1/1996
JP 2006-39314 2/2006

* cited by examiner

*Primary Examiner* — Hoang Ngo
(74) *Attorney, Agent, or Firm* — Scully, Scott, Murphy & Presser, PC

(57) ABSTRACT

A development device has a casing configured with a first frame and a second frame. The first frame includes attachment surfaces to which a regulating member is attached. A facing surface of the second frame is disposed between the attachment surfaces, in a predetermined plane including the attachment surfaces, and configured to face a portion of the regulating member between the attachment surfaces. A seal member is disposed between the regulating member and opposite surfaces including the attachment surfaces and the facing surface, and configured to seal first gaps each of which is formed between the facing surface and one of the attachment surfaces, in a first direction parallel to a rotational axis of a developing member rotatably supported by the casing.

12 Claims, 10 Drawing Sheets

DEVELOPMENT DEVICE AND PRINTER HAVING THE SAME

CROSS-REFERENCE TO RELATED APPLICATION

This application claims priority under 35 U.S.C. §119 from Japanese Patent Application No. 2009-213285 filed on Sep. 15, 2009. The entire subject matter of the application is incorporated herein by reference.

BACKGROUND

1. Technical Field

The following description relates to one or more development devices configured to be incorporated in a printer such as a laser printer.

2. Related Art

As an example of development devices, a development cartridge has been known, which is incorporated in an image forming apparatus and configured to develop an electrostatic latent image on a photoconductive body (e.g., see Japanese Patent Provisional Publication No. 2006-39314). A casing of the development cartridge includes a toner container and a development room separately defined therein. The toner container is configured to accommodate toner. The development room contains therein a development roller configured to hold toner supplied from the toner container on an outer circumferential surface thereof, and a blade configured to regulate the layer thickness of the toner held on the outer circumferential surface of the development roller.

The casing of the development cartridge includes an upper frame and a lower frame. Specifically, the casing of the development cartridge is formed by putting the upper frame on the lower frame and joining the upper and lower frames together in a welding method.

SUMMARY

In assembling the upper and lower frames of the aforementioned development device, the seam between the upper and lower frames includes a portion where the upper and lower frames are not adequately joined in a welding method. Thus, it leads to a gap formed between the upper and lower frame. In general, such a gap is sealed with adhesive material. Nevertheless, in the case where the gap is sealed with adhesive material, even though a procedure for assembling the upper and lower frames is mistakenly performed, it is impossible to reattempt to perform the assembling procedure after the adhesive material is dried. Therefore, the assembling procedure has to carefully be performed. Further, when the adhesive material protruding from the gap sticks to the blade, it might be impossible to remove the blade from the casing for recycling each component included in the development cartridge. Thus, it might result in lower recycling efficiency.

Aspects of the present invention are advantageous to provide one or more improved configurations for a development device, of which a casing is formed with a first frame and a second frame joined together, which configurations make it possible to easily seal a gap between the first frame and the second frame and prevent the reduction of the recycling efficiency of the development device.

According to aspects of the present invention, a development device is provided, which includes a casing configured to accommodate development agent, the casing including a first frame and a second frame, the first frame having an opened first side face and a second side face adjacent to the first side face, the second side face being formed with an opening, the second frame being connected with the first frame so as to seal the first side face of the first frame, a developing member rotatably supported, in the opening, by the casing, the developing member being configured to hold development agent on an outer circumferential surface thereof, a regulating member configured to contact the outer circumferential surface of the developing member so as to regulate a layer thickness of the development agent on the outer circumferential surface of the developing member, two attachment surfaces provided to the second side face of the first frame, the attachment surfaces being disposed at both outsides of the opening in a first direction parallel to a rotational axis of the developing member, respectively, the attachment surfaces being configured such that the regulating member is attached thereto, a facing surface provided to the second frame, the facing surface being disposed between the attachment surfaces, in a predetermined plane including the attachment surfaces, the facing surface being configured to face a portion of the regulating member between the attachment surfaces, and a seal member disposed between the regulating member and the predetermined plane including the attachment surfaces and the facing surface, the seal member being configured to seal first gaps each of which is formed in the first direction between the facing surface and one of the attachment surfaces.

According to aspects of the present invention, further provided is a printer configured to print an image on a sheet. The printer includes a development device detachably incorporated therein. The development device includes a casing configured to accommodate development agent, the casing including a first frame and a second frame, the first frame having an opened first side face and a second side face adjacent to the first side face, the second side face being formed with an opening, the second frame being connected with the first frame so as to seal the first side face of the first frame, a developing member rotatably supported, in the opening, by the casing, the developing member being configured to hold development agent on an outer circumferential surface thereof, a regulating member configured to contact the outer circumferential surface of the developing member so as to regulate a layer thickness of the development agent on the outer circumferential surface of the developing member, two attachment surfaces provided to the second side face of the first frame, the attachment surfaces being disposed at both outsides of the opening in a first direction parallel to a rotational axis of the developing member, respectively, the attachment surfaces being configured such that the regulating member is attached thereto, a facing surface provided to the second frame, the facing surface being disposed between the attachment surfaces, in a predetermined plane including the attachment surfaces, the facing surface being configured to face a portion of the regulating member between the attachment surfaces, and a seal member disposed between the regulating member and the predetermined plane including the attachment surfaces and the facing surface, the seal member being configured to seal first gaps each of which is formed in the first direction between the facing surface and one of the attachment surfaces.

BRIEF DESCRIPTION OF THE ACCOMPANYING DRAWINGS

DETAILED DESCRIPTION

Figure 1:
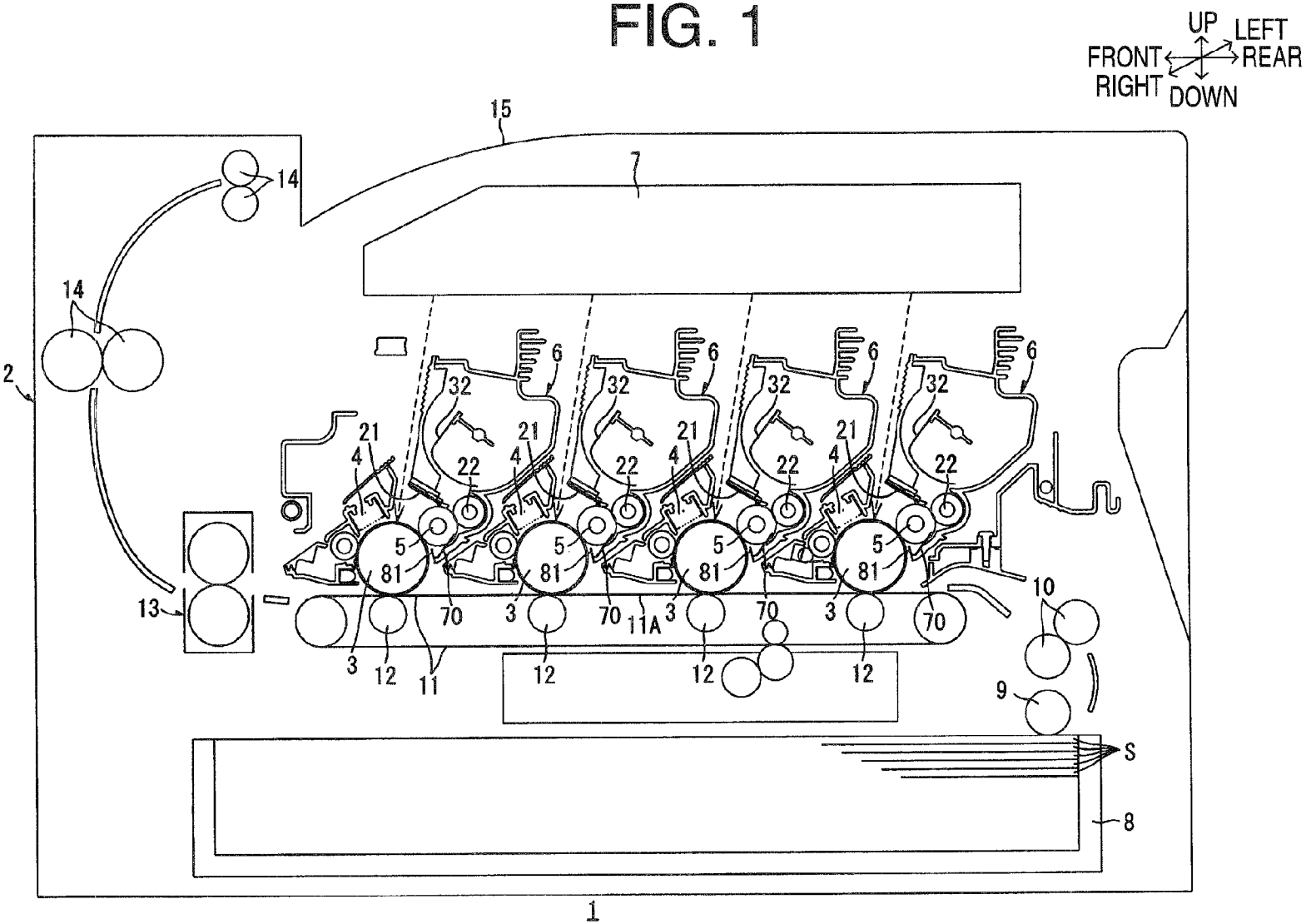
FIG. 1 is a cross-sectional side view showing an internal configuration of a printer in an embodiment according to one or more aspects of the present invention.

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompany drawings. It is noted that when a direction is referred to in the following description, the direction is determined based on the definition thereof as shown in the drawings.

1. Overall Configuration of Printer

A printer 1 of the embodiment is a color printer. As illustrated in FIG. 1, the printer 1 includes a main body casing 2 formed substantially in a box shape.

In the main body casing 2, four photoconductive drums 3 are arranged along a front-to-rear direction. Each photoconductive drum 3 is configured to rotate around a rotational axis thereof extending in a left-to-right direction (hereinafter referred to as a width direction as well). Each photoconductive drum 3 is disposed to face a scorotron-type charging device 4 and a development roller 5. Further, there are four development cartridges 6 each of which is disposed in a position adjacent to and higher than a corresponding one of the photoconductive drums 3. Each development cartridge 6 is configured to hold the development roller 5 and accommodate toner. Each development cartridge 6 is attached to the main body casing 2 in a detachable manner. In each development cartridge 6, the development roller 5 is configured to hold toner on an outer circumferential surface thereof.

In an image forming operation, the outer circumferential surface of each photoconductive drum 3 is evenly charged by the charging device 4, and thereafter exposed with a laser beam (see each dashed-line-arrow shown in FIG. 1) emitted by a scanning unit 7 that is disposed above the main body casing 2. Thereby, an electrostatic latent image based on image data is formed on the outer circumferential surface of each photoconductive drum 3. The electrostatic latent image of each photoconductive drum 3 is visualized with the toner held on a corresponding one of the development rollers 5 being adhered thereto. Namely, a toner image is formed on the outer circumferential surface of the each photoconductive drum 3.

At a bottom side in the main body casing 2, a feed cassette 8 is disposed, in which sheets S are stacked in an up-to-down direction. In the image forming operation, a top one of the sheets S is picked up by a pickup roller 9 upward with a rear end of the top sheet in the feed cassette 8 as a leading end in a sheet feeding direction.

A conveying belt 11 is an endless belt. In an inside area surrounded by the conveying belt 11, there are four transfer rollers 12 to each of which a transfer bias is applied thereto. Each transfer roller 12 is configured to face a corresponding one of the photoconductive drums 3 across an upper-side portion 11A of the endless conveying belt 11. The sheet S is fed by a pair of registration rollers 10, and then conveyed onto the upper-side portion 11A of the conveying belt 11. The conveying belt 11 conveys the sheet S on the upper-side portion 11A thereof forward in the sheet feeding direction, while turning counterclockwise in FIG. 1.

At that time, the toner image on the outer circumferential surface of each photoconductive drum 3 is transferred, by the transfer bias applied to the corresponding transfer roller 12, onto the sheet S conveyed by the conveying belt 11, in a sequentially overlaid manner. It is noted that the respective toner images on the photoconductive drums 3 are different from each other. Therefore, the toner images of four colors are overlaid on the sheet S, and thus a color image is formed on the sheet S. The sheet S with the color image formed thereon is continuously conveyed by the conveying belt 11 forward to a fixing unit 13 that is disposed in front of the conveying belt 11.

When the sheet S passes through the fixing unit 13, the toner image transferred onto the sheet S is thermally fixed onto the sheet S. After that, the sheet S is fed upward by feed rollers 14 while turning the moving direction thereof from the forward direction to the backward direction. Thereafter, the sheet S is ejected onto a catch tray 15 formed on the main body casing 2. The aforementioned procedure is a flow of the image forming operation by the printer 1.

2. Development Cartridges

In the following description, an explanation will be provided about the development cartridges 6 in a state attached to the main body casing 2. The four development cartridges 6 are configured in the same manner except for their respective different toner colors.

(1) General Overview of Development Cartridges

Figure 3:
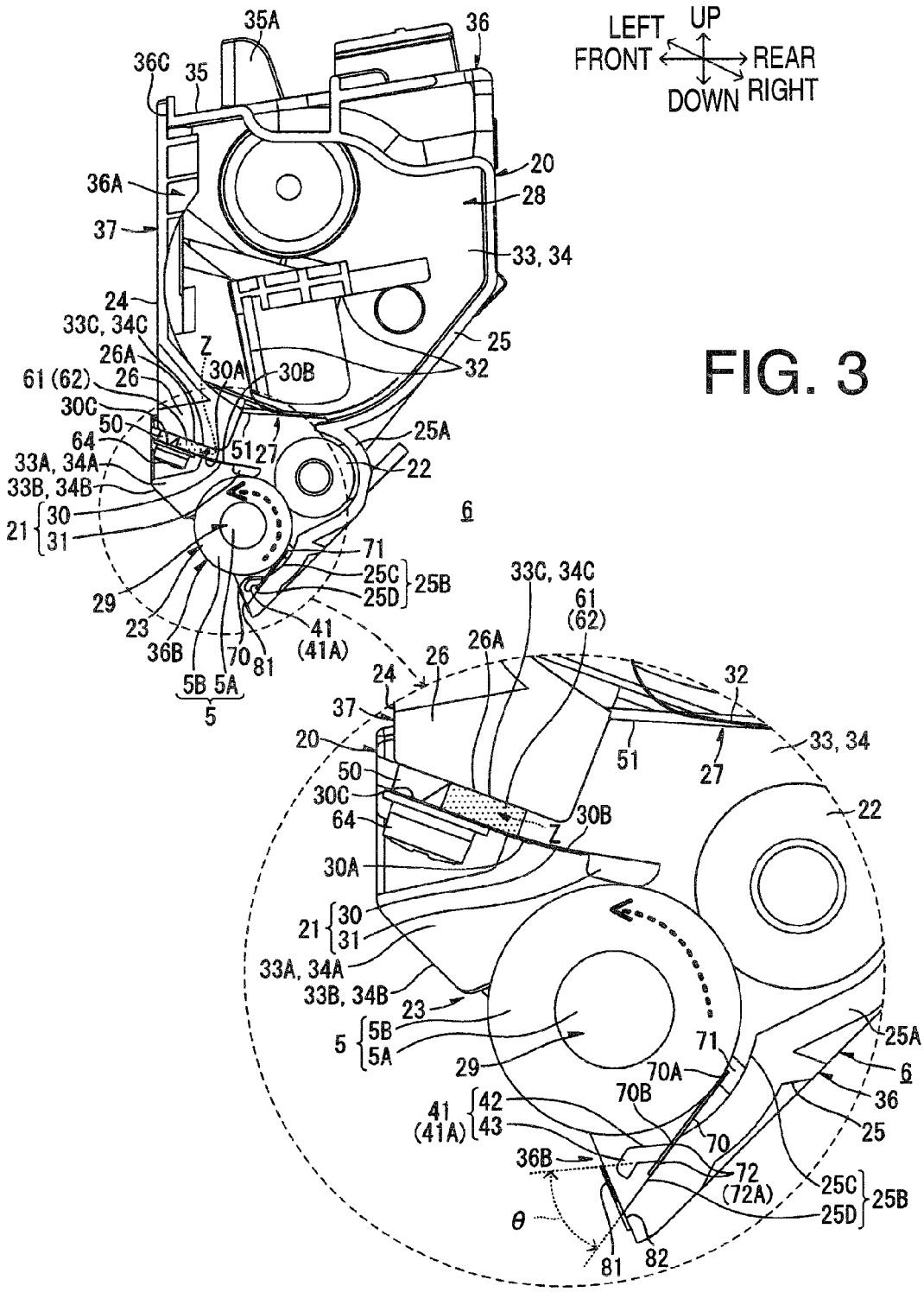
FIG. 3 is a cross-sectional view of the development cartridge along an A-A line shown in FIG. 2B in the embodiment according to one or more aspects of the present invention.

As depicted in FIG. 3, each development cartridge 6 includes, inside a development casing 20, the development roller 5, a layer thickness regulating blade 21, and a supply roller 22.

Figure 2A:
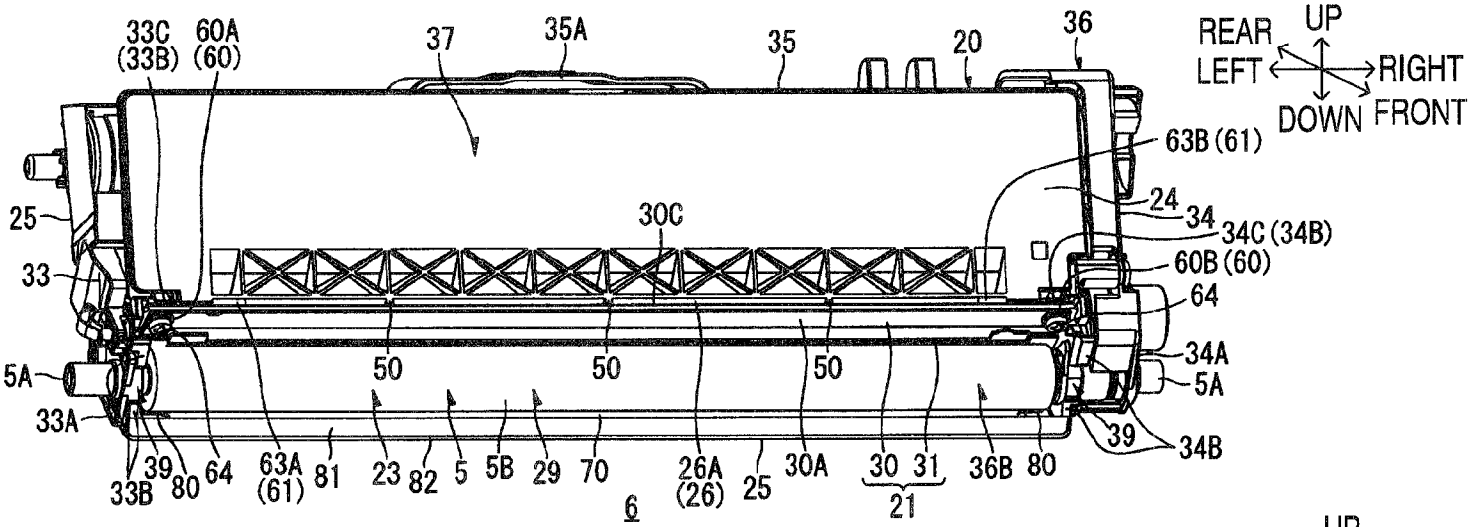
FIG. 2A is a perspective view of a development cartridge when viewed from a left front side in the embodiment according to one or more aspects of the present invention.
Figure 2B:
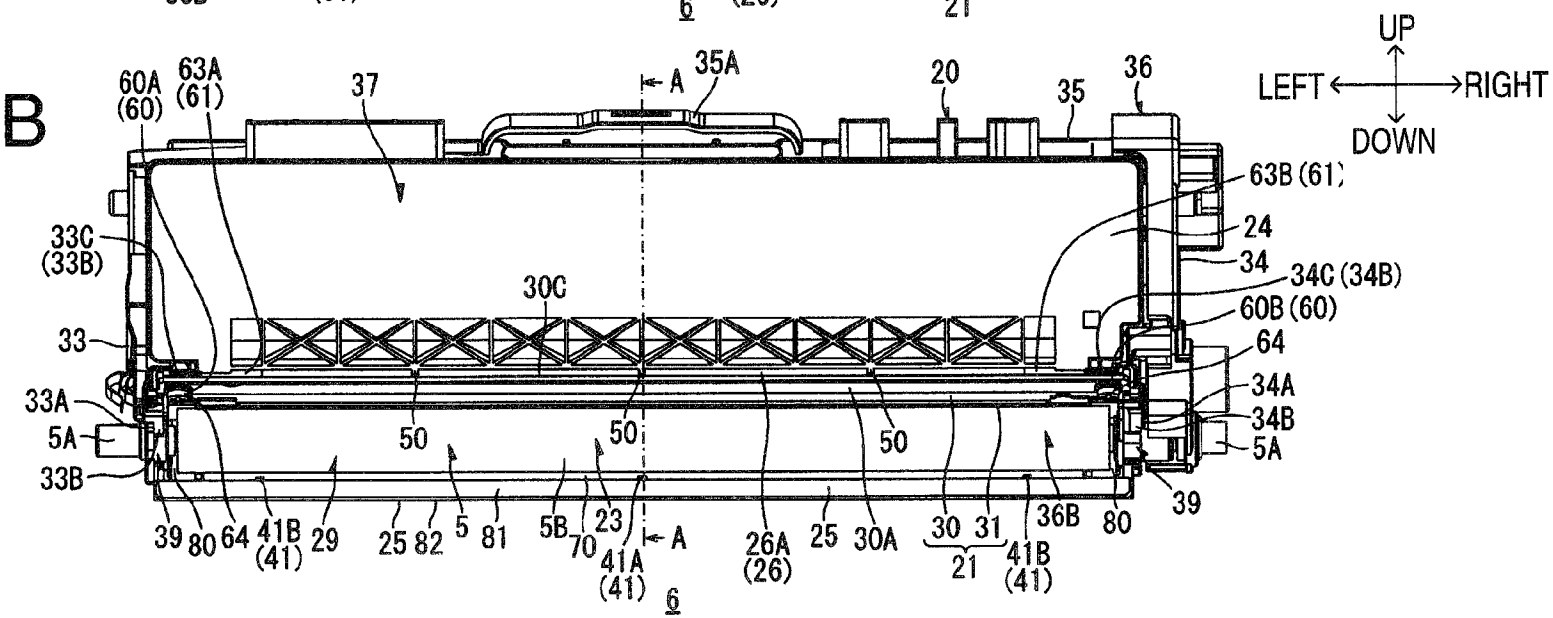
FIG. 2B is a front view of the development cartridge in the embodiment according to one or more aspects of the present invention.

The development casing 20 is formed in a box shape elongated in the left-to-right direction (the width direction), and provided with an opening 23 formed at a lower end of the development casing 20 (see FIGS. 2A and 2B as well). The development casing 20 has a partition wall 26 that extends continuously from a lower end of a front wall 24 to a rear wall 25 of the development casing 20. There is a gap of a predetermined distance between a rear end of the partition wall 26 and the rear wall 25, and a communication hole 27 is formed in the gap. Inside the development casing 20, an upper-side area relative to the partition wall 26 is defined as a toner container room 28, while a lower-side area relative to the partition wall 26 is defined as a development room 29 configured to communicate with the opening 23. The toner container room 28 and the development room 29 communicate with each other via the communication hole 27.

The development roller 5 has a longitudinal direction thereof in the width direction. The development roller 5 includes a cylinder-solid-shaped roller shaft 5A that extends in the width direction, and a cylinder-hollow-shaped rubber roller 5B that covers the roller shaft 5A except for both ends of the roller shaft 5A in the width direction. The roller shaft 5A and the rubber roller 5B are formed concentrically when viewed in the width direction. The development roller 5 is housed in the development room 29 and rotatably supported by the development casing 20. A circular center of the development roller 5 corresponds to a rotational axis of the development roller 5 when viewed in the width direction. The rotational axis of the development roller 5 extends in the width direction. The development roller 5 is exposed out of the opening 23 to a lower front side, and faces and contacts an upper rear side of the corresponding photoconductive drum 3 (see FIG. 1). Thus, the development roller 5 is rotatably supported by (a portion of) the development casing 20 around the opening 23.

The layer thickness regulating blade 21 includes a plate spring 30 formed in a thin plate elongated in the width direction, and a press-contact rubber 31 provided at a rear end of the plate spring 30. The plate spring 30 is disposed to face a lower front side of the partition wall 26. The press-contact rubber 31 establishes press-contact with an upper side of the outer circumferential surface of the development roller 5 (the rubber roller 5B) owing to an elastic force of the plate spring 30. The supply roller 22 has a longitudinal direction thereof in the width direction in the same manner as the development roller 5. The supply roller 22 is disposed near a boundary between the toner container room 28 and the development room 29 (i.e., under the communication hole 27). The supply roller 22 is rotatably supported by the development casing 20. A rotational axis of the supply roller 22 extends in the width direction. The supply roller 22 contacts an upper rear side of the development roller.

The toner container room 28 stores toner to be supplied to the development roller 5. As an example of the toner, a single non-magnetic component of polymerized toner may be employed. The polymerized toner contains substantially spherical particles and has a preferred fluidity. An agitator 32 is provided in the toner container room 32. The agitator 32 is configured to rotate around a rotational axis extending in the width direction. In the aforementioned image forming operation, the toner stored in the toner container room 28 drops from the communication hole 27 to the development room 29 while being agitated by the agitator 32 rotating. Thus, the toner is supplied to the supply roller 22. After that, the toner is supplied to the development roller 5 due to rotation of the supply roller 22. The toner supplied to the development roller 5 enters into between the press-contact rubber 31 of the layer thickness regulating blade 21 and the outer circumferential surface of the development roller 5 (the rubber roller 5B), along with rotation of development roller 5. There, the toner is regulated with respect to the thickness thereof, and held in a form of thin layer on the outer circumferential surface of the development roller 5. Namely, the layer thickness regulating blade 21 regulates the thickness of the toner on the outer circumferential surface of the development roller 5 with the press-contact rubber 31 contacting the outer circumferential surface of the development roller 5.

(2) Details about Development Cartridge

In the following description, the development roller 5 rotates counterclockwise when viewed from the right side, as shown by the thick dashed-line arrow in FIG. 3.

(2-1) Development Casing

As depicted in FIGS. 2A and 2B, the development casing 20 includes a left wall 33 and a right wall 34 that are disposed to face each other across a predetermined distance in the width direction, and a top wall 35, as well as the aforementioned front wall 24 and rear wall 25.

Here, the front wall 24 extends substantially vertically while the rear wall 25 extends toward a lower front side (see FIG. 3). Namely, a clearance in the front-to-rear direction between the front wall 24 and the rear wall 25 becomes smaller downward. An intermediate section of the rear wall 25 in the up-to-down direction, which intermediate section faces the supply roller 22 in the front-to-rear direction, protrudes rearward in an arc shape so as to curve along a rear-side outer circumferential surface of the supply roller 22 (hereinafter, referred to as a protruding section 25A, see FIG. 3). A lower end of the rear wall 25 extends in the width direction.

The left wall 33 is provided between a left end of the front wall 24 and a left end of the rear wall 25. The right wall 34 is provided between a right end of the front wall 24 and a right end of the rear wall 25. As described above, the clearance in the front-to-rear direction between the front wall 24 and the rear wall 25 becomes smaller downward. Therefore, each of the left wall 33 and the right wall 34 has such a triangle shape as to become narrower downward. The top wall 35 seals a portion surrounded by upper ends of the front wall 24, the rear wall 24, the left wall 25, and the right wall 34, from an upper side of the surrounded portion. The top wall 35 has a handle that is provided integrally therewith in a central position of an upper surface of the top wall 32 in the width direction. The handle 35A is configured to be gripped in moving the development cartridge 6.

A lower end of the front wall 24 extends in the width direction, and is located higher than each lower end of the rear wall 25, the left wall 33, and the right wall 34. The aforementioned opening 23 is defined to be surrounded by the lower ends of the front wall 24, the rear wall 25, the left wall 33, and the right wall 34. Thus, the opening 23 is formed substantially in a rectangular shape elongated in the width direction when viewed from the front side. Further, the aforementioned development room 29 is defined to be surrounded by the partition wall 26 that extends rearward continuously from the lower end of the front wall 24, the rear wall 25 (more specifically, the protruding section 25A and a section lower than the protruding section 25A), and the lower ends of the left wall 33 and the right wall 34 (see FIG. 3).

Figure 4A:
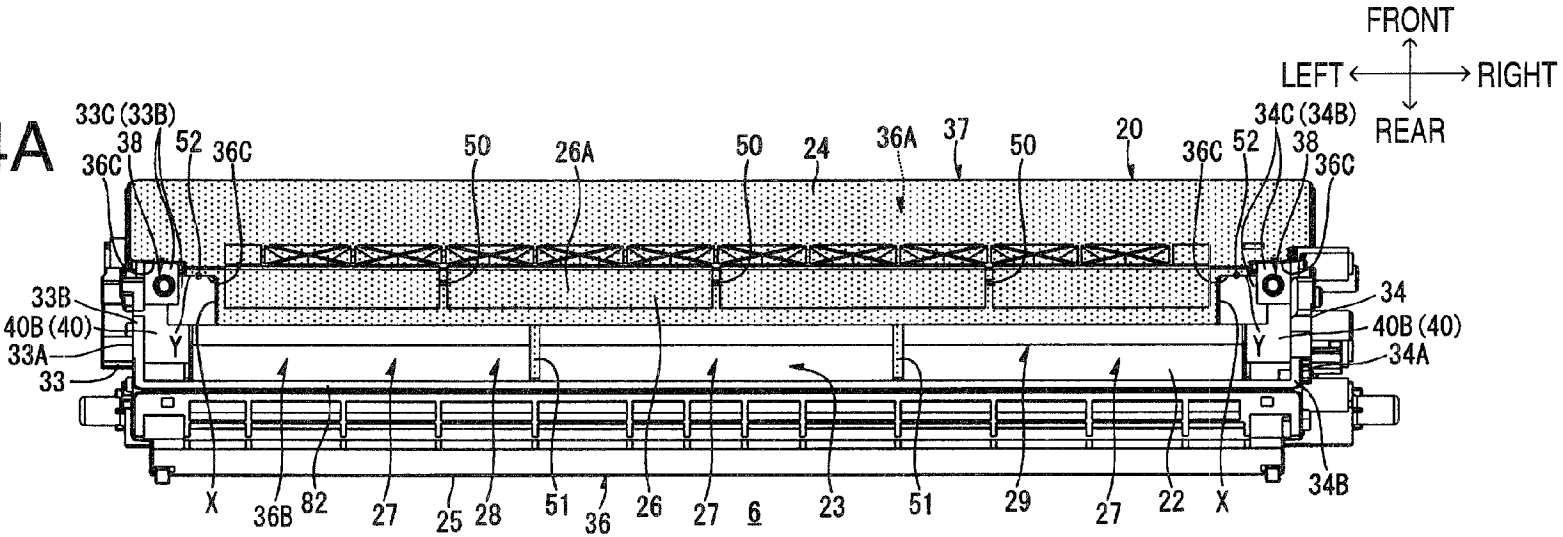
FIG. 4A is a bottom view of the development cartridge in a state where a development roller and a layer thickness regulating blade are removed in the embodiment according to one or more aspects of the present invention.

It is noted that, as illustrated in FIG. 4A, in the development casing 20, an integrated section containing the partition wall 26 and the front wall 24 (hereinafter referred to as a second frame 37, see a section filled with a dot pattern) and a section other than the second frame 37 (hereinafter referred to as a first frame 36) are originally separate components.

(2-1-1) First Frame

Figure 5A:
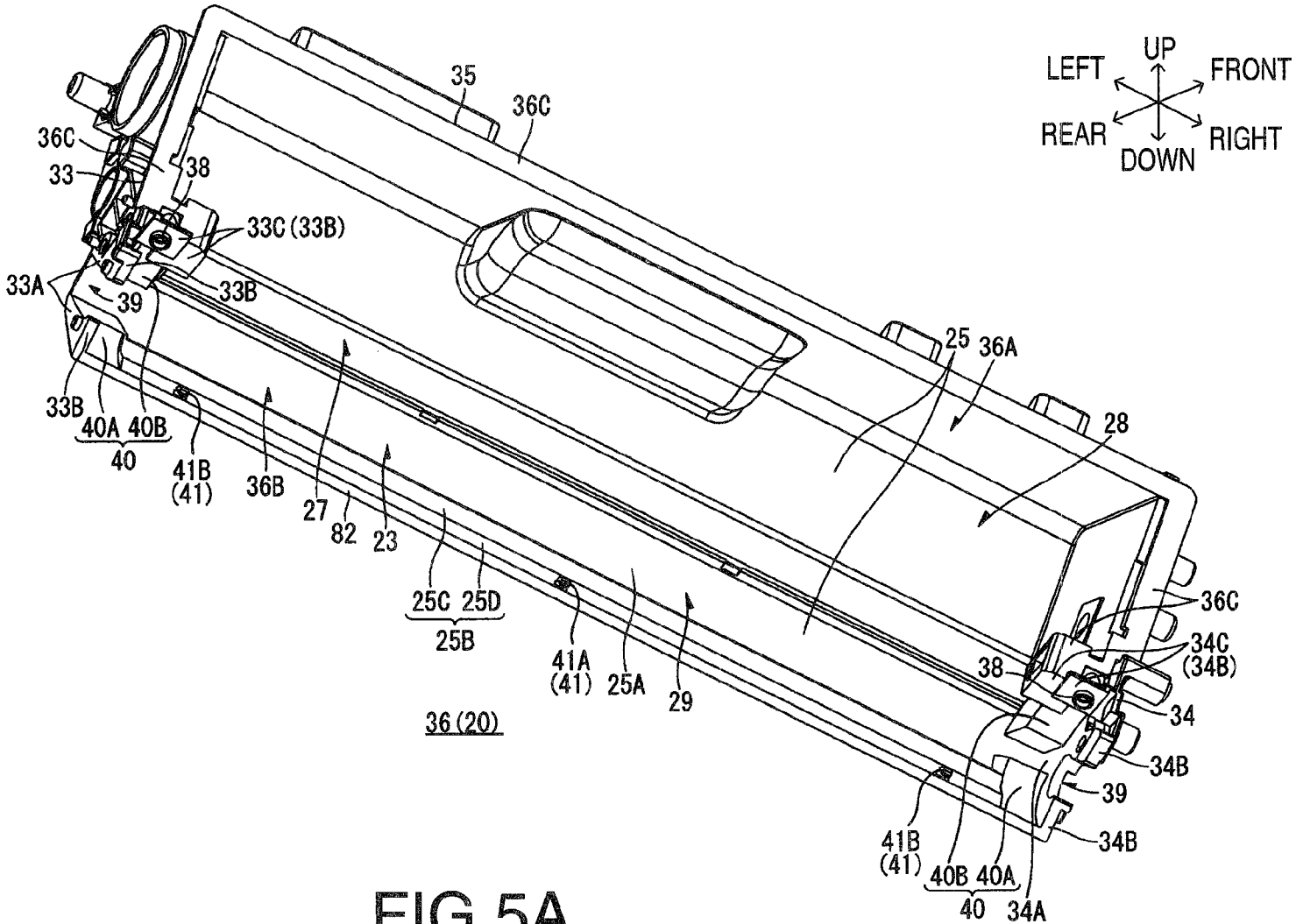
FIG. 5A is a perspective view of a first frame of the development cartridge when viewed from a left front side in the embodiment according to one or more aspects of the present invention.

As shown in FIG. 5A, the first frame 36 is formed in a tray shape with a front face 36A thereof being substantially entirely opened. The first frame 36 has the aforementioned opening 23 formed at a lower face 36B adjacent to the front face 36A from the lower side. The opening 23 is continuous with an opened portion of the front face 36A.

The left wall 33 includes a lower end portion that is one of portions defining the opening 23, which will be referred to as a defining portion 33A. The right wall 34 includes a lower end portion that is one of the portions defining the opening 23, which will be referred to as a defining portion 34A. A lower end surface 33B of the defining portion 33A forms a left end of the lower face 36B. A lower end surface 34B of the defining portion 34A forms a right end of the lower face 36B. The lower end surface 33B includes an attachment surface 33C provided at a front side thereof. The lower end surface 34B includes an attachment surface 34C provided at a front side thereof. The attachment surfaces 33C and 34C, which form a pair, are disposed at both outsides of the opening 23 in the width direction, respectively. The attachment surface 33C protrudes inward (i.e., rightward or toward the opening 23) in the width direction relative to a portion of the lower end surface 33B that is located at a rear side relative to the attachment surface 33C. The attachment surface 34C protrudes inward (i.e., leftward or toward the opening 23) in the width direction relative to a portion of the lower end surface 34B that is located at a rear side relative to the attachment surface 34C. The attachment surfaces 33C and 34C are substantially in the same plane when viewed in the width direction.

Each of the attachment surfaces 33C and 34C is formed substantially in a rectangular shape when viewed from the lower side. Further, an inner end of each of the attachment surfaces 33C and 34C (i.e., a right end of the attachment surface 33C and a left end of the attachment surface 34C) in the width direction extends substantially linearly along the front-to-rear direction. A front end of each of the attachment surfaces 33C and 34C extends substantially linearly along the width direction. A middle section between the inner end and the front end of each of the attachment surfaces 33C and 34C is formed to bend as a step. Additionally, each of the attachment surfaces 33C and 34C includes a screw hole 38 formed in a position slightly shifted outward from the center of each of the attachment surfaces 33C and 34C in the width direction.

Each of the defining portions 33A and 34A includes a shaft insertion groove 39 formed such that a lower end (which rims the opening 23) of each defining portion (33A, 34A) is notched to open to an upper rear side. The deepest portion (an upper rear end) of each shaft insertion groove 39 is a position where the development roller (more strictly, the roller shaft 5A, see FIG. 3) is fixed.

The first frame 36 includes seal pedestals 40 provided around the opening 23 (within the development room 29). The seal pedestals 40 are formed integrally with the defining portions 33A of the left wall 33 and the defining portion 34A of the right wall 34, respectively. Further, the seal pedestals 40 extend inward from inner side faces of the left wall 33 and the right wall 34 in the width direction, respectively. The seal pedestals 40 are provided at both ends of the opening 23 in the width direction in the first frame 36. Each seal pedestal 40 is located at a rear side relative to one of the attachment surfaces 33C and 34C that is at the same side as the seal pedestal in the width direction.

Each seal pedestal 40 is formed to, when viewed in the width direction, be an embowed surface that is recessed rearward so as to curve along the outer circumferential surface of the development roller 5 (see FIG. 3) supported by the development casing 20. Specifically, each seal pedestal 40 is divided, near a corresponding one of the shaft insertion grooves 39, into a lower-side (rear-side) first surface 40A and an upper-side (front-side) second surface 40B. In each seal pedestal 40, the first surface 40A extends in a curved fashion from the shaft insertion groove 39 toward a lower front side, and the second surface 40B extends in a curved fashion from the shaft insertion groove 39 toward an upper front side.

Hereinafter, a front surface (which partially defines a rear side of the development room 29) of the lower end of the rear wall 25 included in the first frame 36 will be referred to as a rear wall defining surface 25B. The rear wall defining surface 25B is sandwiched between (the first surfaces 40A of) the two seal pedestals 40 disposed along the left-to-right direction. An upper half portion of the rear wall defining surface 25B is a curved surface 25C that is formed to, when viewed in the width direction, protrude in an arc shape toward a lower rear side. Further, a lower half portion of the rear wall defining surface 25B is a flat surface 25D that extends substantially linearly from a lower end of the curved surface 25C toward a lower front side (see FIG. 3 as well).

Three engagement projections 41 (41A and 41B) are formed integrally with the flat surface 25D in a substantially central position, a left end position, and a right end position on the flat surface 25D in the width direction, respectively. Referring to an enlarged view of a region surrounded by a dashed line in FIG. 3, each engagement projection 41 includes, in an integrated manner, a protruding section 42 that protrudes forward from the flat surface 25D, and a bending section 43 that extends in a bending manner from a front end of the protruding section 42 toward the lower front side.

Relative to the development roller 5 supported by the development casing 20 as depicted in FIG. 3, the bending section 43 is bent in such a direction as to be farther (from the development roller 5). An angle θ between the flat surface 25D and each protruding section 42 is set to be equal to or less than 90 degrees.

(2-1-2) Second Frame

Figure 6A:
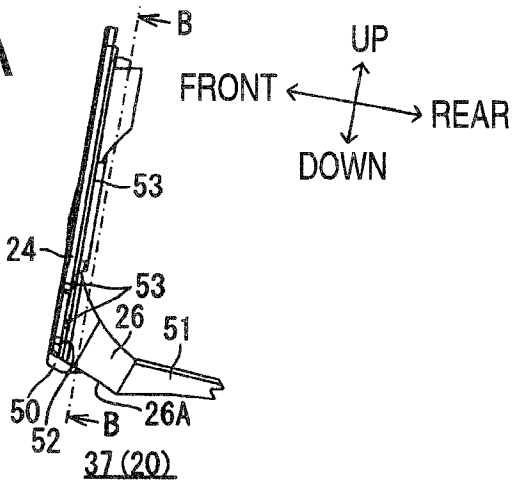
FIG. 6A is a right side view of a second frame of the development cartridge in the embodiment according to one or more aspects of the present invention.

As illustrated in FIG. 6A, the second frame 37 is configured by integrating the partition wall 26 and the front wall 24, and formed to be elongated in the width direction with a lower end of the second frame 37 being bent rearward.

As shown in FIG. 4A, the partition wall 26 is formed to, when viewed from the lower side, be rectangular in a manner elongated in the width direction. Each end of the partition wall 26 in the left-to-right direction (the width direction) extends substantially linearly in the front-to-rear direction. The dimension of the partition wall 26 in the width direction (i.e., the distance between the left end and the right end of the partition wall 26) is slightly smaller than the distance between the attachment surface 33C at the side of the left wall 33 and the attachment surface 34C at the side of the right wall 34 of the first frame 36.

A lower surface of the partition wall 26 is flat substantially over the entire area thereof, and hereinafter will be referred to as a facing surface 26A. On the facing surface 26A, plural ribs 50 (in the embodiment, three ribs 50) are formed at intervals of a predetermined distance in the width direction, integrally with the facing surface 26A. Each rib 50 extends in the front-to-rear direction and protrudes downward from the facing surface 26A (see FIG. 6). A rear end of the partition wall 26 extends substantially linearly in the width direction, and plural bars 51 (in the embodiment, two bars 51) are formed in a middle area of the rear end of the partition wall 26 in the width direction, integrally with the partition wall 26. Each bar 51 is elongated in the front-to-rear direction, and extends rearward from the rear end of the partition wall 26.

Figure 6B:
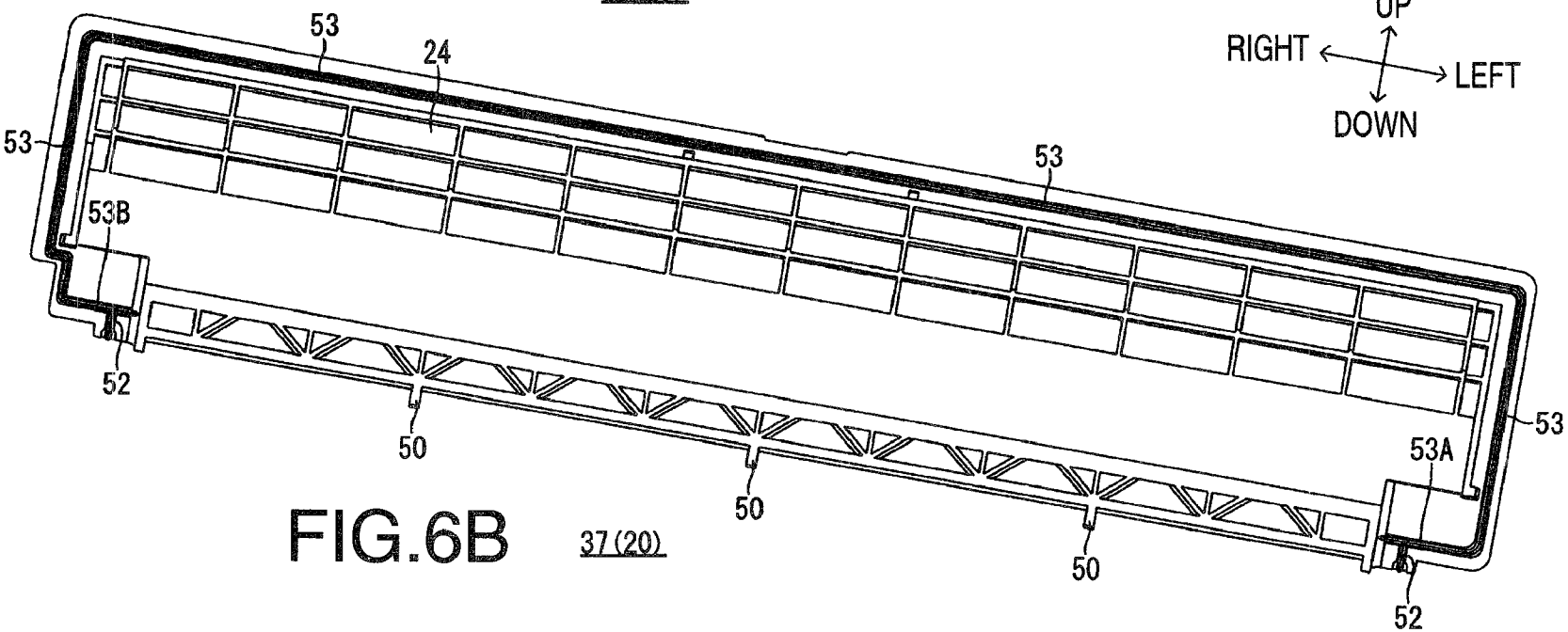
FIG. 6B is a cross-sectional rear view of the second frame of the development cartridge along a B-B line shown in FIG. 6A in the embodiment according to one or more aspects of the present invention.

Further, as shown in FIG. 6B, in the second frame 37, the front wall 24 has a rear surface formed in a rectangular shape elongated in the width direction. Additionally, on the rear surface of the front wall 24, a joint rib 53 is integrally formed along the outline of the rear surface, so as to protrude slightly rearward from the rear surface. The joint rib 53 is provided slightly inside the outline of the rear surface of the front wall 24, along a figure formed in a rectangle shape elongated in the width direction that is similar to the outline of the rear surface. Nevertheless, the joint rib 53 is disconnected at a lower end of the rear surface of the front wall 24. The aforementioned three ribs 50 are located in the disconnected region (i.e., in a region where the joint rib 53 is disconnected).

Further, at the lower end side of the rear surface of the front wall 24, a left section (i.e., a lower left rib 53A) and a right section (i.e., a lower right rib 53B) of the joint rib 53 relative to the disconnected region extend linearly along the width direction. At each inside end of the lower left rib 53A and the lower right rib 53B in the width direction, a stop rib 52 is formed. Each stop rib 52 extends downward from a corresponding one of the lower left rib 53A and the lower right rib 53B, up to a lower edge of the rear surface of the front wall 24. It is noted that the stop ribs 52 may be provided to not only the second frame 37 but also the first frame 36 (see FIGS. 5A to 5C), or may be provided only to the first frame 36.

(2-1-3) Assembly of Development Casing

Figure 4B:
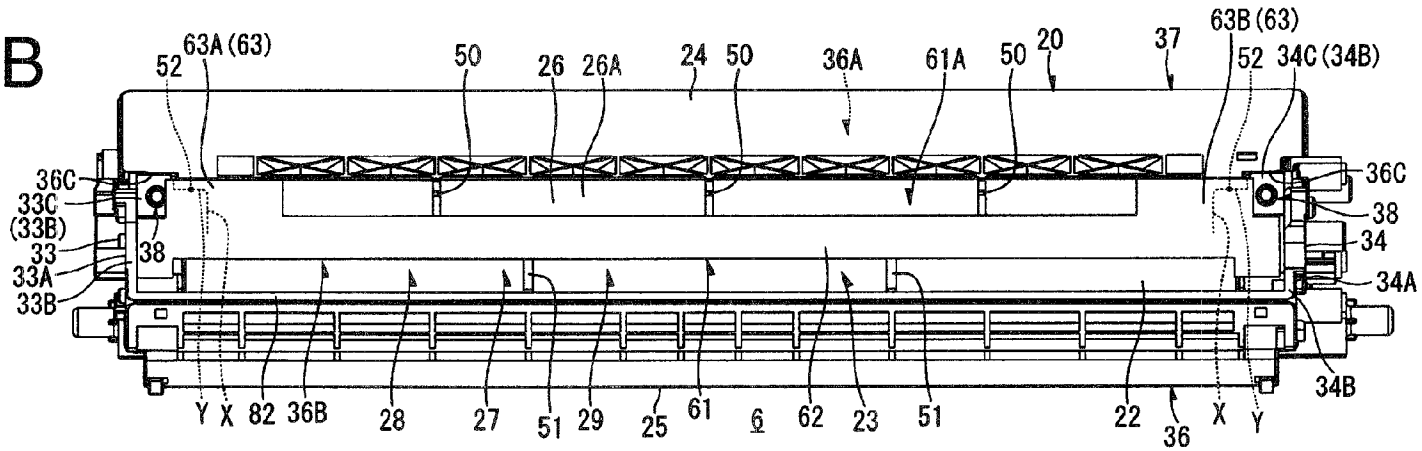
FIG. 4B is a bottom view of the development cartridge with a seal member added to the state shown in FIG. 4A in the embodiment according to one or more aspects of the present invention.

Referring to FIG. 4B, an explanation will be provided about assembly of the development casing 20. To assemble the development casing 20 that includes the first frame 36 and the second frame 37, the second frame 37 is joined with the first frame 36 so as to cover, from the front side, the opened front face 36A of the first frame 36.

Specifically, the front wall 24 of the second frame 37 shuts the opened front face 36A of the first frame 36 from the front side. At this time, the stop ribs 52 and the joint rib 53 of the front wall 24 (see FIG. 6B) are, from the front side, brought into contact with a portion (hereinafter referred to as a rim section 36C, see FIGS. 5A to 5C) of the first frame 36 that rims the opened front face 36A, and connected with the rim section 36C in an ultrasonic welding method. Thereby, when the joint rib 53 and the stop ribs 52 of the second frame 37 are connected in the welding method with the rim section 36C of the first frame 36 such that the second frame 37 is joined with the first frame 36, the development casing 20 is completely assembled.

In this state, the partition wall 26 of the second frame 37 is fitted between the attachment surface 33C of the left wall 33 and the attachment surface 34C of the right wall 34 that are included in the first frame 36. Therefore, the facing surface 26A, which is a lower surface of the partition wall 26, is disposed between the two attachment surfaces 33C and 34C. In this state, the facing surface 26A is substantially in the same plane as the two attachment surfaces 33C and 34C when viewed in the width direction (see FIG. 3).

In the state where the development casing 20 is assembled in the aforementioned manner, each bar 51 of the partition wall 26 of the second frame 37 contacts the rear wall 25 of the first frame 36 from the front side. Thereby, an adequate stiffness of a portion of the development casing 20 that surrounds the communication hole 27 is ensured. Thus, in the state where the development casing 20 is assembled, there is no gap between the rim section 36C rimming the front face 36A of the first frame 36 (see FIGS. 5A to 5C) and the ribs (i.e., the joint rib 53 and the stop ribs 52) of the front wall 24 (see FIG. 6). Meanwhile, gaps (hereinafter referred to as first gaps X, see FIGS. 4A and 4B) are inevitably formed, each of which is, in the width direction, between a corresponding one of the attachment surfaces 33C and 34C and the facing surface 26A disposed between the attachment surfaces 33C and 34C. Each first gap X, which is formed on a corresponding one of both sides of the facing surface 26A in the width direction, extends substantially linearly along the front-to-rear direction between the facing surface 26A and a corresponding one of the attachment surfaces 33C and 34C. Further, each first gap X communicates with the communication hole 27 and the toner container 28 (see FIG. 3).

Figure 5B:
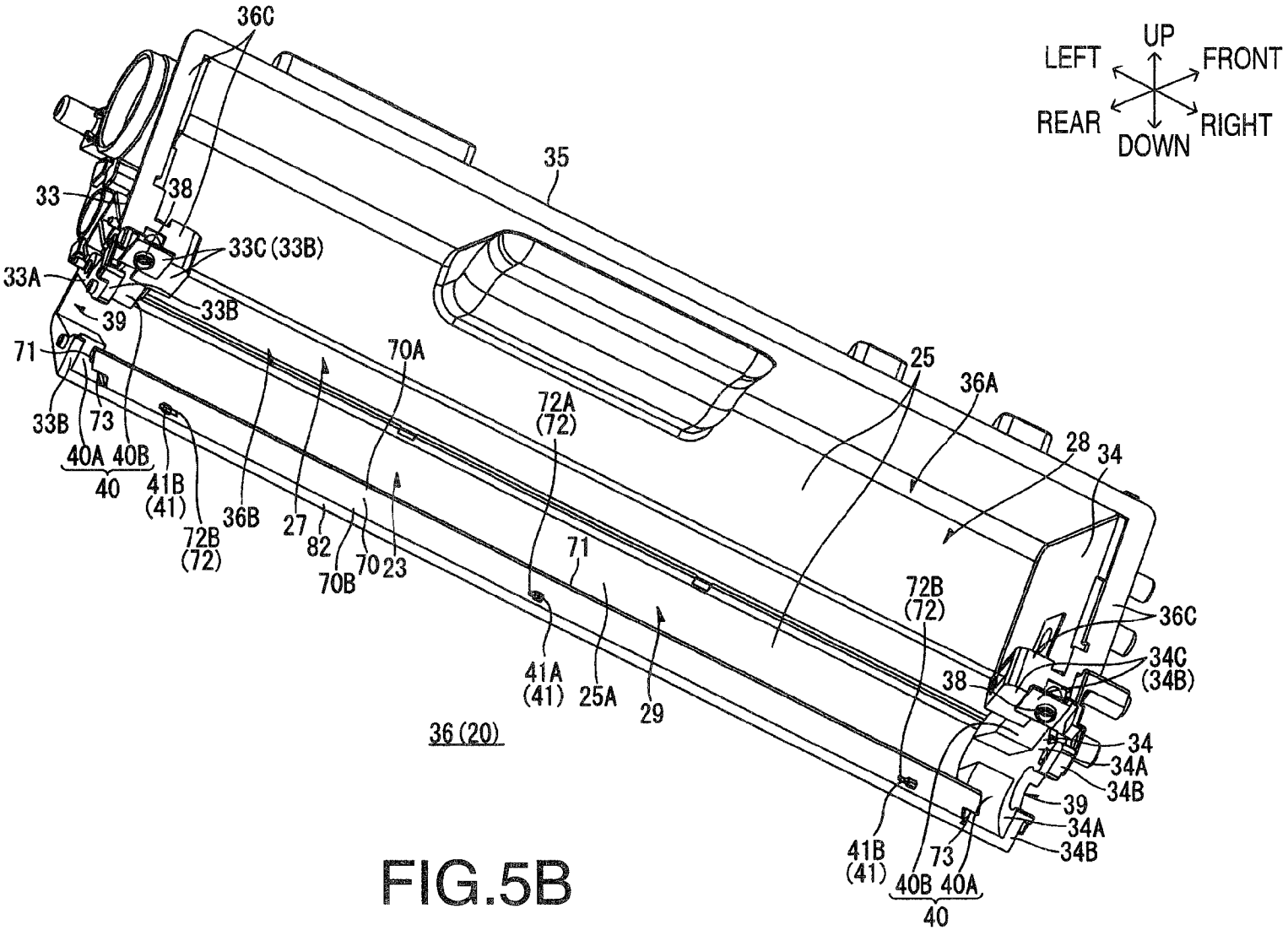
FIG. 5B is a perspective view of the first frame of the development cartridge to which a lower film is attached in the embodiment according to one or more aspects of the present invention.
Figure 5C:
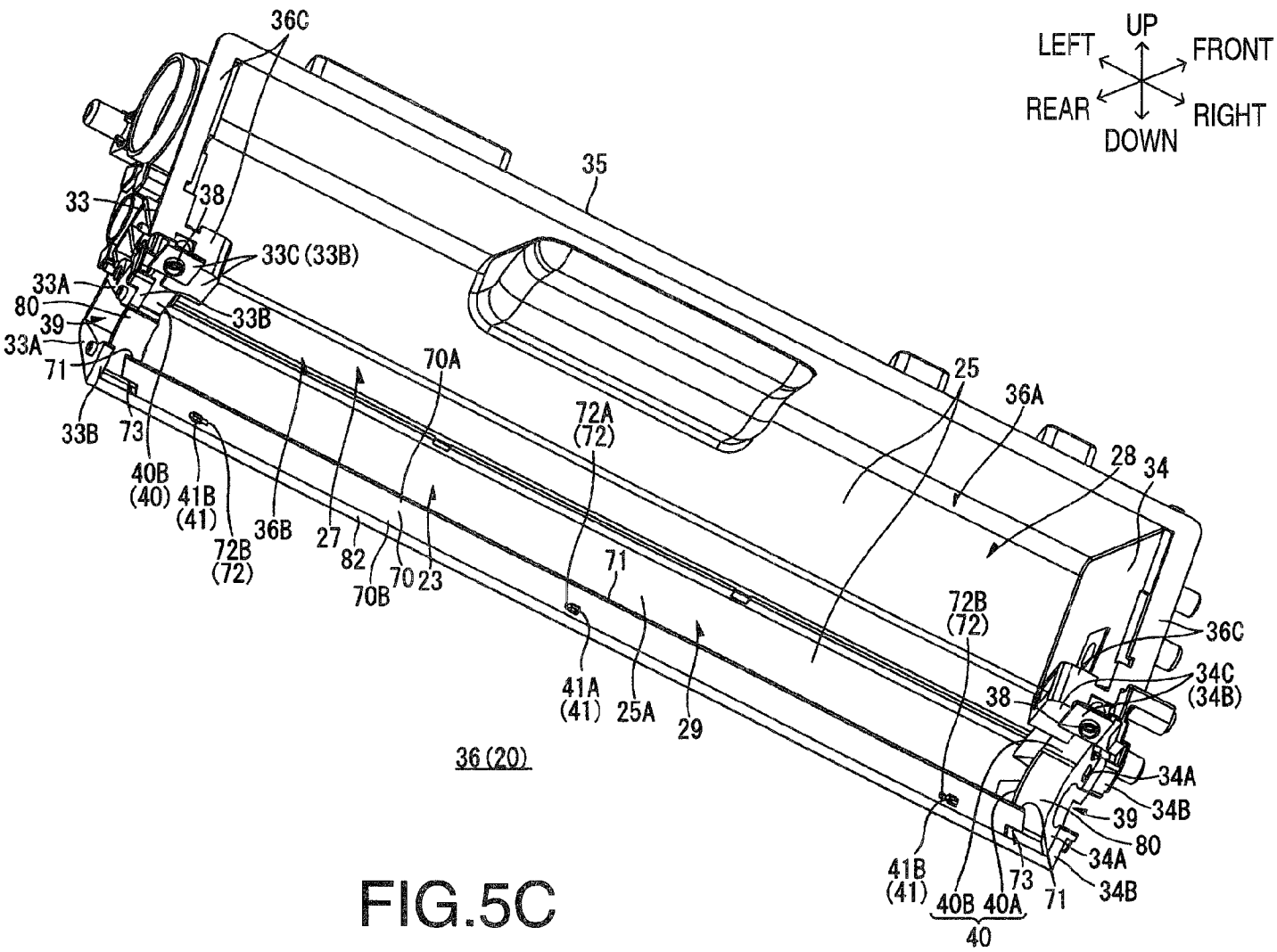
FIG. 5C is a perspective view of the first frame of the development cartridge to which side seals are attached in the embodiment according to one or more aspects of the present invention.

Further, a front end of each of the attachment surfaces 33C and 34C forms a part of the aforementioned rim section 36C (see FIGS. 5A to 5C). The front end of the left attachment surface 33C faces a left portion, relative to the partition wall 26, of the lower end of the front wall 24 from the rear side. The front end of the right attachment surface 34C faces a right portion, relative to the partition wall 26, of the lower end of the front wall 24 from the rear side. Therefore, gaps (hereinafter referred to as second gaps Y), which extend substantially linearly along the width direction, are formed respectively in the following two regions: one of the regions is between the front end of the attachment surface 33C and the left portion, relative to the partition wall 26, of the lower end of the front wall 24, and the other is between the front end of the attachment surface 34C and the right portion, relative to the partition wall 26, of the lower end of the front wall 24. Each second gap Y is continuous, at an inside end thereof in the width direction, with the front end of one of the first gaps X that is at the same side as the second gap Y in the width direction. It is noted that above each second gap Y, a corresponding one of the lower left rib 53A and the lower right rib 53B (see FIG. 6B) is disposed. Thereby, communication between each second gap Y and the toner container 28 (see FIG. 3) is blocked by a corresponding one of the lower left rib 53A and the lower right rib 53B.

Thus, the toner container 28 (see FIG. 3) is in communication with the development room 29 via the communication hole 27 and the left and right first gaps X. Nevertheless, the toner container 28 is cut off (hermetically sealed) from the outside, except for the communication via the communication hole 27 and the left and right first gaps X. Further, each of the aforementioned stop ribs 52 is on the same-side one of the second gaps Y in the width direction, in the state connected in the welding method with the rim section 36C of the first frame 36. Therefore, each second gap Y is blocked and divided in the middle by a corresponding one of the stop ribs 52.

(2-2) Layer Thickness Regulating Blade

Figure 7A:
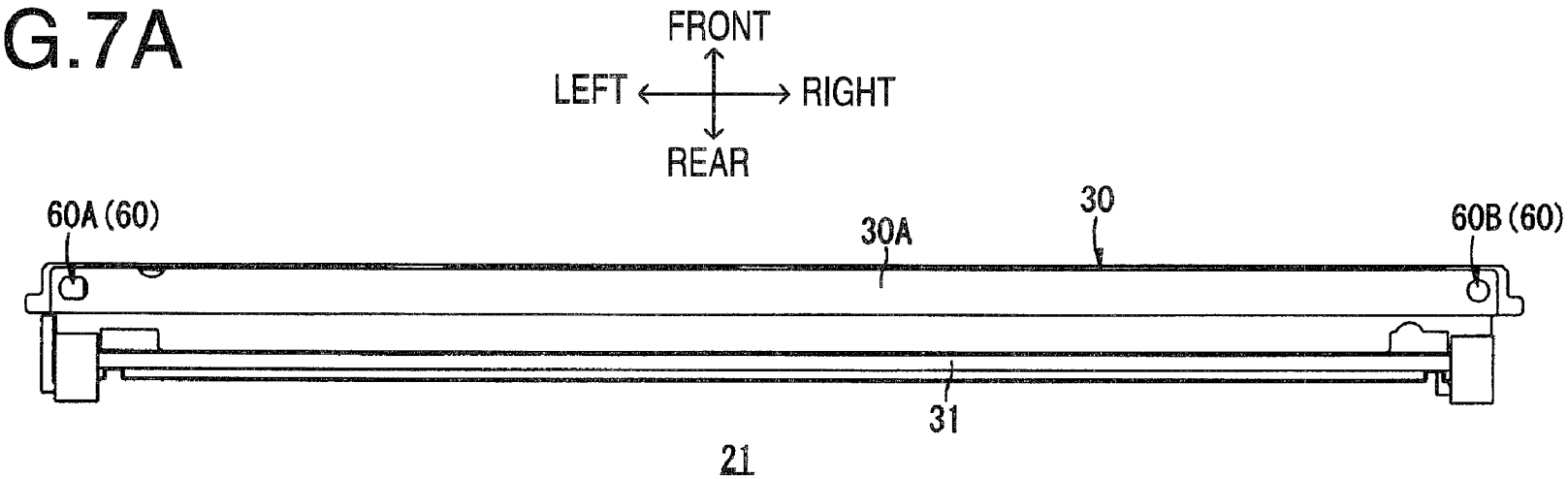
FIG. 7A is a bottom view of a layer thickness regulating blade attached to the development cartridge in the embodiment according to one or more aspects of the present invention.

An explanation will be provided about the layer thickness regulating blade 21 with reference to FIG. 7A. In the layer thickness regulating blade 21, the press-contact rubber 31 is disposed at a rear end of a lower surface 30A of the plate spring 30, along the width direction. The plate spring 30 includes a through hole 60 formed at each side, in the width direction, of a front end of the plate spring 30. Each through hole 60 penetrates the plate spring 30 in the up-to-down direction. A left one 60A of the through holes 60 is formed to be slightly elongated in the width direction. A right one 60B of the through holes 60 is a round hole.

Figure 7B:
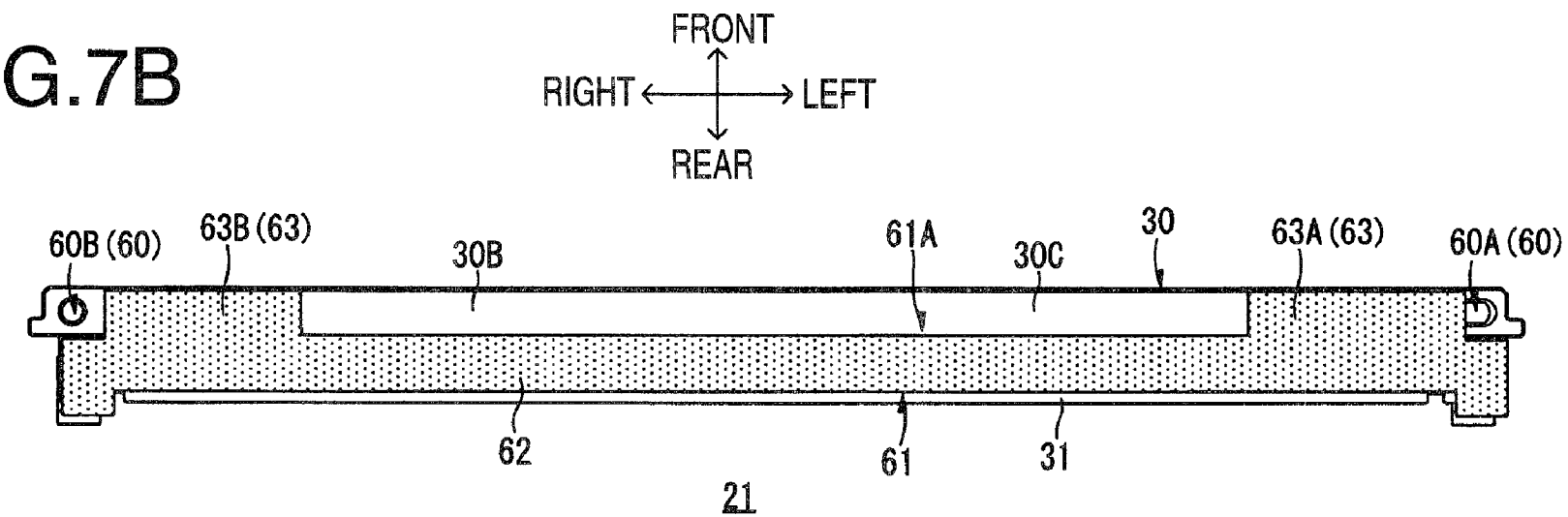
FIG. 7B is a top view of the layer thickness regulating blade attached to the development cartridge in the embodiment according to one or more aspects of the present invention.

As illustrated in FIG. 7B, an upper surface 30B of the plate spring 30 is provided with a seal member 61 (which is filled with dots in FIG. 7B). The seal member 61 is formed in a strip shape elongated in the width direction. The seal member 61 has substantially the same length as the plate spring 30 in the width direction. Further, the seal member 61 is made of elastic material such as a sponge. The seal member 61 is provided integrally with a first section 62 elongated in the width direction and second sections 63 respectively provided at both sides of the first section 62 in the width direction. Each end of the first section 62 in the width direction is slightly bent rearward. The second sections 63 extend forward (i.e., in a direction perpendicular to the width direction) respectively from the both ends of the first section 62 in the width direction. Therefore, the seal member 61 is formed as a whole in a U-shape flattened in the front-to-rear direction with an open front side thereof when viewed from the upper side. Namely, the seal member 61 has a recessed area 61A formed to be recessed rearward from the front end of the seal member 61.

The seal member 61 is attached, from the upper side, to the upper surface 30B of the plate spring 30, e.g., via a double-sided adhesive tape. In this state, a rear end of the first section 62 is located slightly in front of a rear end of the plate spring 30. A front end of each second section 63 is located so as to coincide with a front end of the plate spring 30. The left second section 63A is adjacent to the right side of the left through hole 60A. The right second section 63B is adjacent to the left side of the right through hole 60B. In this state, the upper surface 30B of the plate spring 30 includes a surrounded section 30C that is surrounded by the first section 62 and the left and right second sections 63.

In the layer thickness regulating blade 21 with the seal member 61 attached to the plate spring 30, as depicted in FIG. 2, a screw 64 is inserted into each of the through holes 60 (see FIGS. 7A and 7B) formed at the both ends of the plate spring 30 in the width direction. Further, each screw 64 is screwed into a corresponding one of the screw holes 38 (see FIG. 4A) that is at the same side as the screw 64 in the width direction. Thereby, the layer thickness regulating blade 21 is attached, from the lower side, to the attachment surface 33C of the left wall 33 that has the screw hole 38 formed therein and the attachment surface 34C of the right wall 34 that has the screw hole 38 formed therein.

In this state, the layer thickness regulating blade 21 is provided between and fixed to the left wall 33 and the right wall 34. Thus, as shown in FIG. 3, the plate spring 30 is configured to face, from the lower side, the attachment surfaces 33C and 34C and the partition wall 26 across the seal member 61. Further, the lower surface (i.e., the facing surface 26A) of the partition wall 26 faces, from the upper side, a portion of the plate spring 30 between the attachment surfaces 33C and 34C (see FIG. 4A).

Each screw 64 is screwed into a corresponding one of the screw holes 38 (see FIG. 4). Therefore, the seal member 61 is pinched and compressed between the plate spring 30 and the opposite elements such as the attachment surfaces 33C and 34C and the partition wall 26, due to a force applied for screwing the screws 64 into the screw holes 38.

Attention is now drawn to FIG. 4B. The first section 62 of the seal member 61 thus compressed faces, from the lower side, the facing surface 26A and the attachment surfaces 33C and 34C pinching the facing surface 26A. Namely, the first section 62 is between the layer thickness regulating blade 21 and the opposite surfaces such as the facing surface 26A and the attachment surfaces 33C and 34C, so as to seal a gap Z (see FIG. 3) between the layer thickness regulating blade 21 and the opposite surfaces such as the facing surface 26A and the attachment surfaces 33C and 34C over the entire length of the gap Z in the width direction. Therefore, the first section 62 prevents the toner in the development casing 20 from leaking out of the development casing 20.

On the other hand, the left second section 63A seals, from the lower side, the left one of the first gaps X and the left one of the second gaps Y that is continuous with the left first gap X. Further, the right second section 63B seals, from the lower side, the right one of the first gaps X and the right one of the second gaps Y that is continuous with the right first gap X. Therefore, the toner stored in the toner container 28 (see FIG. 3) is prevented from leaking downward (toward the layer thickness regulating blade 21) from the first gaps X.

Additionally, in a situation where the toner, which is in the first gaps X, might leak outside in the width direction from the second gaps Y, the toner is blocked by the stop ribs 52 from leaking outside in the width direction from the second gaps Y each of which is blocked and divided in the middle by a corresponding one of the stop ribs 52.

Each screw hole 38 is located adjacent to one of the second sections 63 that is at the same side, in the width direction, of a corresponding one of the attachment surfaces 33C and 34C. Further, each rib 50, which is formed on the lower surface (i.e., the facing surface 26A) of the partition wall 26, is located at the front side of the first section, between the two second sections 63, when viewed from the lower side. Moreover, each rib 50 contacts the surrounded section 30C (see FIG. 7B) of the upper surface 30B of the plate spring 30, via the recessed area 61A of the seal member 61, from the upper side (see FIG. 3).

(2-3) Lower Film and Elastic Member

As illustrated in FIG. 3, the development cartridge 6 includes a lower film 70, which is configured to prevent the toner from leaking from between the outer circumferential surface of the development roller 5 (i.e., the outer circumferential surface of the rubber roller 5B, and the same will apply to the following explanation) and the rear wall 25 of the development casing 20. Further, the development cartridge 6 includes an elastic member 71, which is configured to press the lower film 70 against the outer circumferential surface of the development roller 5.

Figure 8A:
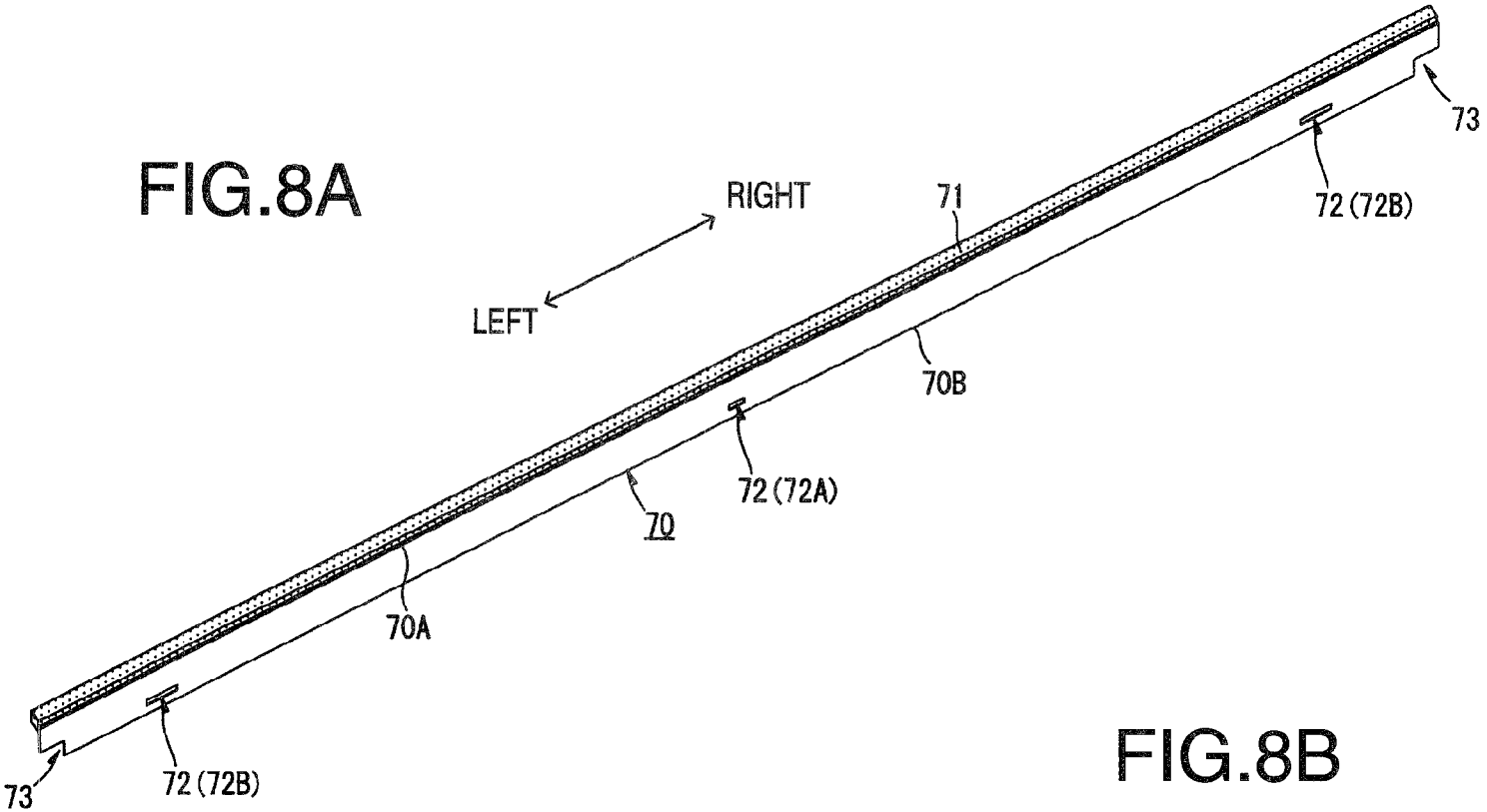
FIG. 8A is a perspective view showing the lower film and an elastic member in the embodiment according to one or more aspects of the present invention.
Figure 8B:
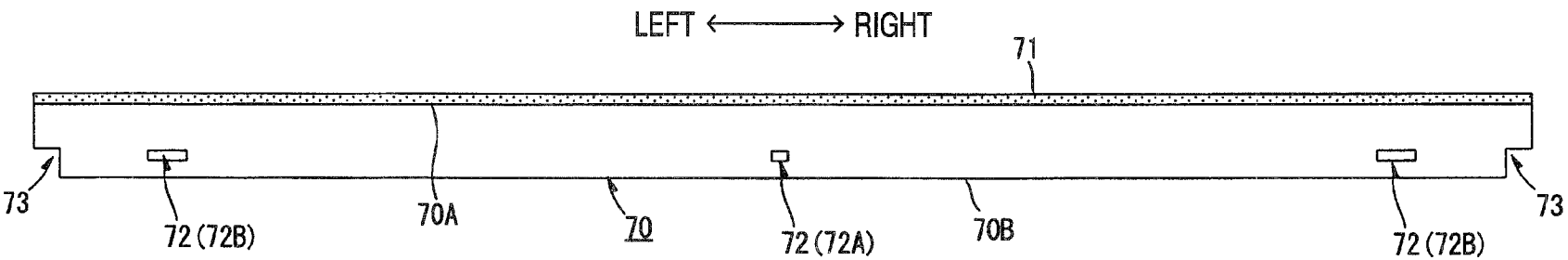
FIG. 8B shows the lower film and the elastic member in a state attached to the development cartridge when viewed from an upper front side in the embodiment according to one or more aspects of the present invention.

As depicted in FIGS. 8A and 8B, the lower film 70 is formed from a flexible material such as a PET sheet and a rubber sheet, substantially in a rectangular shape elongated in the width direction. The lower film 70 has an upper end referred to as a free end 70A, and a lower end referred to as a base end 70B. Each of an upper edge of the free end 70A and a lower edge of the base end 70B extends linearly along the width direction.

The base end 70B has through holes elongated in the width direction (hereinafter referred to as engagement holes 72). The engagement holes 72 (72A and 72B) are located in respective positions slightly upward away from the lower edge of the base end 70B, at substantially the center and both sides of the base end 70B in the width direction. The engagement hole 72B at each side of the base end 70B in the width direction is longer in the width direction than the engagement hole 72A substantially at the center of the base end 70B in the width direction. Further, substantially L-shaped notched sections 73 are formed at both corners of the base end 70B in the width direction.

The elastic member 71 is shown filled with a dot pattern in FIGS. 8A and 8B. The elastic member 71 is formed from elastic material such as sponge and rubber, substantially in a shape of square-pole elongated in the width direction. The dimension of the elastic member 71 in the width direction is substantially the same as that of the free end 70A of the lower film 70.

Subsequently, an explanation will be provided about assembly of the lower film 70 and the elastic member 71 in the development cartridge 6. As illustrated in FIG. 5B, when the lower film 70 is brought into a posture extended in the width direction, each engagement hole 72 of the lower film 70 is engaged with a corresponding one of the engagement projections 41 that is in the same position as the engagement hole 72, in the width direction on the rear wall 25 of the development casing 20. Specifically, the engagement projection 41A substantially in the center in the width direction is engaged with the engagement hole 72A substantially in the center in the width direction. Additionally, the left engagement projection 41B is engaged with the left engagement hole 72B. Further, the right engagement projection 41B is engaged with the right engagement hole 72B.

Here, the engagement projection 41A substantially in the center in the width direction is engaged with the engagement hole 72A with little clearance therebetween in the width direction. Nevertheless, the left and right engagement projections 41B are respectively engaged with the left and right engagement holes 72B wider than the engagement hole 72A, with allowance for a clearance between the engagement projections 41B and the engagement holes 72A in the width direction. Therefore, first by engaging the engagement projection 41A with the engagement hole 72A, the center of the lower film 70 in the width direction is positioned. Thereafter, by engaging the left and right engagement projections 41B with the left and right engagement holes 72B, respectively, with allowance for the clearance between the engagement projections 41B and the engagement holes 72A in the width direction, the lower film 70 is attached to the development casing 20 in a wrinkle-free state.

Thus, When the engagement projections 41 are engaged with the engagement holes 72, the lower film 70 extends toward an upper rear side, from the base end 70B to the free end 70A in a state where the base end 70B is located closer to the rear wall 25 (the development casing 20) than the free end 70A (see FIG. 3 as well).

Then, the elastic member 71 is placed between the free end 70A of the lower film 70 and the rear wall 25 (the development casing 20). It is noted that the elastic member 71 may previously be placed on the rear wall 25, and thereafter the engagement projections 41 may be engaged with the engagement holes 72 of the lower film 70. In this case as well, consequently, the elastic member 71 is placed between the free end 70A and the rear wall 25. It is noted that the elastic member 71 is not completely hidden behind the free end 70A, but protrudes from the free end 70A toward the upper rear side over the entire length of the elastic member 71 in the width direction (see FIG. 3 as well).

In this state, in the case where the development roller 5 is attached to the development casing 20, the lower film 70 extends from the rear wall 25 toward the outer circumferential surface of the development roller 5 when viewed in the width direction, such that the free end 70A is closer to the outer circumferential surface of the development roller than the base end 70B (see the enlarged view of FIG. 3). The free end 70A contacts, from a lower rear side, the entire length of the outer circumferential surface of the development roller 5 (the rubber roller 5B) in the width direction.

In addition, the elastic member 71 faces, from a lower rear side, the entire length of the outer circumferential surface of the development roller 5 in the width direction. Concurrently, the elastic member 71 presses the entire length of the free end 70A of the lower film 70 in the width direction against the entire length, in the width direction, of the lower rear side of the outer circumferential surface of the development roller 5. The elastic member 71 is compressed between the development roller 5 and the rear wall 25, and presses the free end 70A by a force for restoring itself from the compressed state to an original state.

Then, a portion of the elastic member 71, which protrudes from the free end 70A toward an upper rear side as described above, presses, from a lower rear side, a portion of the outer circumferential surface of the development roller 5 which portion is adjacent to the free end 70A downstream relative to the free end 70A in the rotational direction of the development roller 5. Therefore, the elastic member 71 presses both the free end 70A of the lower film 70 and the portion of the outer circumferential surface of the development roller 5 which portion is adjacent to the free end 70A.

Thus, the elastic member 71 presses the free end 70A of the lower film 70 against the outer circumferential surface of the development roller 5. Hence, the free end 70A is positioned while being elastically pinched between the elastic member 71 and the outer circumferential surface of the development roller 5 in gap-less close contact with the outer circumferential surface of the development roller 5. In addition, the lower film 70 seals the gap between the lower rear side of the outer circumferential surface of the development roller 5 and the rear wall 25 (specifically, the rear wall defining surface 25B). Moreover, the elastic member 71 (specifically, the portion of the elastic member 71 that protrudes from the free end 70A toward the upper rear side) seals the gap between the lower rear side of the outer circumferential surface of the development roller 5 and the rear wall 25. Namely, the gap between the lower rear side of the outer circumferential surface of the development roller 5 and the rear wall 25 is sealed doubly by the lower film 70 and the elastic member 71.

In this state, when the development roller 5 rotates (see the thick dashed-line arrow in FIG. 3), the outer circumferential surface of the development roller 5 slides relative to the free end 70A of the lower film 70 and the elastic member 71. Nonetheless, the gap between the lower rear side of the outer circumferential surface of the development roller 5 is always sealed. Thereby, the toner, stored at the rear side relative to the development roller 5 inside the development casing 20, is prevented from leaking outside the development cartridge 6 from between the lower rear side of the outer circumferential surface of the development roller 5 and the rear wall 25.

(2-4) Side Seals

As shown in FIG. 5C, the development casing 20 is provided with two side seals 80. The side seals 80 are configured to prevent the toner held on the development roller 5 (see FIG. 1) from leaking outside the development casing 20 from both sides, in the width direction, of the outer circumferential surface of the development roller 5.

Each side seal 80 is formed in a strip shape elongated along a corresponding one of the substantially arcate seal pedestals 40 (see FIGS. 5A and 5B). Further, each side seal 80 is formed from elastic material such as felt and sponge. Each side seal 80 is attached to a corresponding one of the seal pedestals 40 via a double-sided adhesive tape (not shown), so as to bridge the first surface 40A and the second surface 40B (i.e., so as to seal a region, broken by the seal pedestal 40, between the first surface 40A and the second surface 40B) (see FIG. 5B). In this state, each side seal 80 is curved as a whole in an arched shape recessed rearward along a corresponding one of the seal pedestals 40, when viewed in the width direction. The two side seals 80 contact, from the rear side, both sides of the elastic member 71 in the width direction, respectively, so as to overlap the both sides of the elastic member 71 in the width direction when viewed in the front-to-rear direction (or when viewed in a radial direction of the development roller 5 that is perpendicular to the width direction).

In the development roller 5 (see FIG. 3) attached to the development casing 20, each end of the roller shaft 5A in the width direction is fitted into the deepest portion (the upper-rear-side end) of the shaft insertion groove 39 of a corresponding one of the left and right walls 33 and 34 that is at the same side in the width direction, via a bearing (not shown).

In this state, in the development roller 5, a rear-side outer circumferential surface of each end of the rubber roller 5B in the width direction contacts the side seal 80 attached to a corresponding one of the seal pedestals 40 (see FIG. 5) that is at the same side in the width direction, so as to press, from the front side, the side seal 80 against the corresponding seal pedestal 40 (see FIGS. 2A and 2B). Thereby, each side seal 80 seals the gap between one of the seal pedestals 40 and one end of the outer circumferential surface of the rubber roller 5B that are at the same side in the width direction.

In this state, when the development roller 5 rotates, the rear-side outer circumferential surface of each end of the development roller 5 (the rubber roller 5B) in the width direction contacts a corresponding one of the side seals 80 in a sliding manner. Thereby, at that time, the toner is prevented from leaking outside, in the width direction, a region of the outer circumferential surface of the rubber roller 5B between the left and right side seals 80.

(2-5) Block Member

In the development casing 20, a block member 81 configured from a PET sheet elongated in the width direction is attached, from the lower side, to a portion (hereinafter referred to as an attachment portion 82) that defines the lower end of the opening 23, using a double-sided adhesive tape. Thereby, the toner stored at a lower side of the opening 23 inside the development casing 20 is blocked by the block member 81 from leaking from the opening 23.

3. Operations and Effects

As described above, in the development cartridge 6 shown in FIG. 3, the development casing 20, which stores the toner, includes the first frame 36 (see FIGS. 5A to 5C) configured such that the front face 36A thereof is opened and the lower face 36B thereof adjacent to the front face 36A has the opening 23, and the second frame 37 (see the portion filled with the dots in FIG. 4A) joined with the first frame 36 so as to cover the front face 36A of the first frame 36.

Here, the development roller 5, which is configured to hold the toner on the outer circumferential surface thereof, is rotatably supported, in the opening 23, by the development casing 20. Further, the layer thickness regulating blade 21, which is configured to regulate the layer thickness of the toner on the outer circumferential surface of the development roller 5, contacts the outer circumferential surface of the development roller 5.

As illustrated in FIG. 4A, in the lower face 36B of the first frame 36 that has the opening 23, the two attachment surfaces 33C and 34C, to which the layer thickness regulating blade 21 is attached, are provided respectively at the both sides of the opening 23 in the rotational axis direction of the development roller 5 (i.e., in the width direction).

The second frame 37 is provided with the facing surface 26A. The facing surface 26A is in the same plane as the two attachment surfaces 33C and 34C and disposed between the two attachment surfaces 33C and 34C. Further, the facing surface 26A is configured to face a portion, of the layer thickness regulating blade 21, which is between the two attachment surfaces 33C and 34C (see FIG. 3).

In addition, the seal member 61 is between the layer thickness regulating blade 21 and the opposite surfaces, i.e., the attachment surfaces 33C and 34C and the facing surface 26A (see FIG. 3). As shown in FIG. 4B, the seal member 61 seals the first gaps X each of which is formed in the width direction between a corresponding one of the attachment surfaces 33C and 34C and the facing surface 26A.

Therefore, it is possible to seal the first gaps X formed between the first frame 36 and the second frame 37 by placing the seal member 61 between the layer thickness regulating blade 21 and the opposite surfaces (i.e., the attachment surfaces 33C and 34C and the facing surface 26A) (see FIG. 3) without using any adhesive material, in an easier manner than such a configuration that the attachment surfaces 33C and 34C (the first frame 36) and the facing surface 26A (the second frame 37) are bonded together using adhesive material. Thus, it is possible to prevent reduction of recycling efficiency for the development cartridge 6.

The seal member 61 includes the first section 62 that extends along the width direction, and the two second sections 63 that extend forward (i.e., in a direction perpendicular to the width direction) respectively from the both ends of the first section 62 in the width direction. The seal member 61 is configured such that the first section 62 thereof prevents the toner from leaking from the gap Z (see FIG. 3) formed between the layer thickness regulating blade 21 and the opposite surfaces (the attachment surfaces 33C and 34C and the facing surface 26A), and that the second sections 63A and 63B thereof seal the first gaps X.

Namely, as being provided with the first section 62 and the second sections 63, the seal member 61 can concurrently prevent the toner from leaking from the gap Z or the gap X.

Further, the seal member 61 is provided to the layer thickness regulating blade 21 (see FIG. 7B). Therefore, by attaching the layer thickness regulating blade 21 to the attachment surfaces 33C and 34C, it is possible to seal the gap Z (see FIG. 3) and the first gaps X. Additionally, by the pressing force that the layer thickness regulating blade 21 applies against the attachment surfaces 33C and 34C, it is possible to seal the first gaps X from the lower side in a gap-less fashion. Furthermore, the seal member 61, concurrently with the layer thickness regulating blade 21, is detachably attached to the development casing 20. Thus, it leads to enhanced recycling efficiency.

The ribs 50, which are provided on a portion of the facing surface 26A between the two second sections 63, contact the surrounded section 30C (see FIG. 7B), of the layer thickness regulating blade 21, which is surrounded by the first section 62 and the two second sections 63. Hence, it is possible to prevent the layer thickness regulating blade 21 from bending (see FIGS. 2A and 2B). Thereby, the layer thickness regulating blade 21 can contact the outer circumferential surface of the development roller 5 in a gap-less manner evenly over the entire length, in the width direction, of the outer circumferential surface of the development roller 5 (see FIG. 3).

The outline of the outer circumferential surface of the development roller 5 (the rubber roller 5B) is formed in a gently-curved arc shape that slightly hollows toward the center of the development roller 5 in the width direction when viewed from the outside in a radial direction of the development roller 5. Thereby, even though the layer thickness regulating blade 21 bends and sinks at the center thereof in the width direction, the layer thickness regulating blade 21 can contact the outer circumferential surface of the development roller 5 evenly over the entire length, in the width direction, of the outer circumferential surface of the development roller 5.

The layer thickness regulating blade 21 is attached to the attachment surfaces 33C and 34C with the screws 64. As depicted in FIG. 4B, the screw holes 38 are formed in respective positions of the attachment surfaces 33C and 34C each of which positions is adjacent to a corresponding one of the second sections 63. Therefore, by the force applied for attaching the layer thickness regulating blade 21 to the attachment surfaces 33C and 34C with the screws 64, the second sections 63 of the attachment surfaces 33C and 34C that are adjacent respectively to the screw holes 38 are pressed against the first gaps X each of which is formed in the width direction between a corresponding one of the attachment surfaces 33C and 34C and the facing surface 26A. Thus, it is possible to certainly seal the first gaps X.

As illustrated in FIG. 4A, each second gap Y is formed between the first frame 36 and the second frame 37, so as to extend in the width direction in a manner continuous with a corresponding one of the first gaps X.

At least one of the first frame 36 and the second frame 37 (in the embodiment, the second frame 37) is provided with the stop ribs 52. The stop ribs 52 are configured to extend in the up-to-down direction (a direction perpendicular to the width direction) and block the toner from leaking outside in the width direction from the second gaps Y.

The second frame 37 is joined with the first frame 36 in a state where the stop ribs 52 thereof are connected in the welding method with (the rim section 36C of) the first frame 36. Thus, the stop ribs 52 can seal the second gaps Y so as to certainly prevent the toner from leaking from the second gaps Y.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible.

What is claimed is:

1. A development device comprising:

a casing configured to accommodate development agent, the casing comprising a first frame and a second frame, the first frame having an opened first side face and a second side face adjacent to the first side face, the second side face being formed with an opening, the second frame being connected with the first frame so as to seal the first side face of the first frame;

a developing member rotatably supported, in the opening, by the casing, the developing member being configured to hold development agent on an outer circumferential surface thereof;

a regulating member configured to contact the outer circumferential surface of the developing member so as to regulate a layer thickness of the development agent on the outer circumferential surface of the developing member;

two attachment surfaces provided to the second side face of the first frame, the attachment surfaces being disposed at both outsides of the opening in a first direction parallel to a rotational axis of the developing member, respectively, the attachment surfaces being configured such that the regulating member is attached thereto;

a facing surface provided to the second frame, the facing surface being disposed between the attachment surfaces, in a predetermined plane including the attachment surfaces, the facing surface being configured to face a portion of the regulating member between the attachment surfaces; and a seal member disposed between the regulating member and the predetermined plane including the attachment surfaces and the facing surface, the seal member being configured to seal first gaps each of which is formed in the first direction between the facing surface and one of the attachment surfaces.

2. The development device according to claim 1, wherein the seal member comprises a first section and two second sections, wherein the first section is configured to extend in the first direction, and to prevent the development agent stored in the casing from leaking from between the regulating member and each opposite surface, in the predetermined plane, which includes the attachment surfaces and the facing surface, and wherein the two second sections are configured to extend in a second direction that is perpendicular to the first direction and parallel to the predetermined plane, respectively from both ends of the first section in the first direction, and to seal the first gaps.

3. The development device according to claim 2, wherein the seal member is provided to the regulating member.

4. The development device according to claim 3, further comprising a plurality of ribs formed in an area on the facing surface between the two second sections, wherein each of the ribs is configured to contact a portion, of the regulating member, which is surrounded by the first section and the second sections of the seal member.

5. The development device according to claim 2, wherein each of the attachment surfaces comprises a screw attachment section disposed in a position adjacent to a corresponding one of the second sections of the seal member, and wherein the regulating member is attached to the attachment surfaces with screws screwed in the screw attachment sections.

6. The development device according to claim 1, further comprising block sections provided to at least one of the first frame and the second frame, wherein each of the block sections is configured to extend in a second direction that is perpendicular to the first direction and parallel to the predetermined plane, and to block the development agent stored in the casing from leaking in the first direction from second gaps, wherein each of the second gaps is formed between the first frame and the second frame, and configured to extend in the first direction so as to be continuous with a corresponding one of the first gaps, and wherein the second frame and the first frame are connected with each other at the block sections in a welding method.

7. A printer configured to print an image on a sheet, comprising a development device detachably incorporated in the printer, wherein a development device comprises:

a casing configured to accommodate development agent, the casing comprising a first frame and a second frame, the first frame having an opened first side face and a second side face adjacent to the first side face, the second side face being formed with an opening, the second frame being connected with the first frame so as to seal the first side face of the first frame;

a developing member rotatably supported, in the opening, by the casing, the developing member being configured to hold development agent on an outer circumferential surface thereof;

a regulating member configured to contact the outer circumferential surface of the developing member so as to regulate a layer thickness of the development agent on the outer circumferential surface of the developing member;

two attachment surfaces provided to the second side face of the first frame, the attachment surfaces being disposed at both outsides of the opening in a first direction parallel to a rotational axis of the developing member, respectively, the attachment surfaces being configured such that the regulating member is attached thereto;

a facing surface provided to the second frame, the facing surface being disposed between the attachment surfaces, in a predetermined plane including the attachment surfaces, the facing surface being configured to face a portion of the regulating member between the attachment surfaces; and a seal member disposed between the regulating member and the predetermined plane including the attachment surfaces and the facing surface, the seal member being configured to seal first gaps each of which is formed in the first direction between the facing surface and one of the attachment surfaces.

8. The printer according to claim 7, wherein the seal member comprises a first section and two second sections, wherein the first section is configured to extend in the first direction, and to prevent the development agent stored in the casing from leaking from between the regulating member and each opposite surface, in the predetermined plane, which includes the attachment surfaces and the facing surface, and wherein the two second sections are configured to extend in a second direction that is perpendicular to the first direction and parallel to the predetermined plane, respectively from both ends of the first section in the first direction, and to seal the first gaps.

9. The printer according to claim 8, wherein the seal member is provided to the regulating member.

10. The printer according to claim 9, wherein the development device further comprises a plurality of ribs formed in an area on the facing surface between the two second sections, and wherein each of the ribs is configured to contact a portion, of the regulating member, which is surrounded by the first section and the second sections of the seal member.

11. The printer according to claim 8, wherein each of the attachment surfaces comprises a screw attachment section disposed in a position adjacent to a corresponding one of the second sections of the seal member, and wherein the regulating member is attached to the attachment surfaces with screws screwed in the screw attachment sections.

12. The printer according to claim 7, wherein the development device further comprises block sections provided to at least one of the first frame and the second frame, wherein each of the block sections is configured to extend in a second direction that is perpendicular to the first direction and parallel to the predetermined plane, and to block the development agent stored in the casing from leaking in the first direction from second gaps, wherein each of the second gaps is formed between the first frame and the second frame, and configured to extend in the first direction so as to be continuous with a corresponding one of the first gaps, and wherein the second frame and the first frame are connected with each other at the block sections in a welding method.

* * * * *